US006798434B2

(12) United States Patent
Shibata et al.

(10) Patent No.: US 6,798,434 B2
(45) Date of Patent: Sep. 28, 2004

(54) PRINTING DEVICE

(75) Inventors: Satoshi Shibata, Chita-gun (JP); Mutsuo Fukuoka, Ama-gun (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 2 days.

(21) Appl. No.: 10/395,138

(22) Filed: Mar. 25, 2003

(65) Prior Publication Data

US 2003/0184642 A1 Oct. 2, 2003

(30) Foreign Application Priority Data

Mar. 27, 2002 (JP) ..... 2002-089208

(51) Int. Cl.[7] ..... B41J 35/36; B41J 17/36
(52) U.S. Cl. ..... 347/214; 400/249
(58) Field of Search ..... 347/214; 400/249, 400/703

(56) References Cited

U.S. PATENT DOCUMENTS 4,797,018 A * 1/1989 Hofmann et al. ..... 400/249
5,049,898 A * 9/1991 Arthur et al. ..... 347/19
5,365,312 A * 11/1994 Hillmann et al. ..... 399/12
6,428,132 B1 * 8/2002 Kubatzki et al. ..... 347/7

FOREIGN PATENT DOCUMENTS

| | | | | |
|---|---|---|---|---|
| JP | 60-23090 | * | 2/1985 | ..... B41J/35/36 |
| JP | 03-281275 | * | 12/1991 | ..... 347/214 |
| JP | 4-103380 | * | 4/1992 | ..... B41J/35/36 |
| JP | 06-067507 | * | 3/1994 | ..... B41J/35/36 |

* cited by examiner

*Primary Examiner*—Huan Tran
(74) *Attorney, Agent, or Firm*—Oliff & Berridge, PLC

(57) ABSTRACT

A facsimile machine includes a detachable ribbon cassette accommodating an ink ribbon and having an EEPROM that stores the amount of the ink ribbon consumed. In the facsimile machine, printing is performed while the ink ribbon is taken up by a take-up motor and the memory contents in the EEPROM are renewed according to the progress of printing. The facsimile machine further includes a ribbon-empty detector that detects that the facsimile machine runs out of the ink ribbon, and a CPU that resets the memory contents in the EEPROM of the ribbon cassette.

20 Claims, 14 Drawing Sheets

PRINTING DEVICE

BACKGROUND OF THE INVENTION

1. Field of Invention

The invention relates to a printing device such as a facsimile machine.

2. Description of Related Art

Conventionally, a facsimile machine, which performs printing by a thermal transfer method, uses ink ribbon wound in a roll.

In the above facsimile machine, a take-up shaft for the ink ribbon is linked to a take-up motor. When the take-up motor is driven, the ink ribbon is wound around the take-up shaft. In this case, the amount of the ink ribbon consumed is calculated based on the number of revolutions of the take-up motor, and stored in memory provided in a ribbon cassette accommodating the ink ribbon. When the contents stored in the memory reach a specified value, it is determined that there is no ribbon remaining, that is, the facsimile machine is out of ribbon. In addition, the facsimile machine has a display unit to show the remaining amount of the ink ribbon.

However, in the facsimile machine, the amount of the ink ribbon consumed is determined based on the number of revolutions of the take-up motor. Therefore, when the ink ribbon is actually used, the remaining amount of the ink ribbon stored in the memory may fall out of synch with that of the ink ribbon actually used. As a result, the display unit may show that the ink ribbon still remains, although it actually has run out.

SUMMARY OF THE INVENTION

The invention provides a printing device capable of reliably detecting that the ink ribbon has run out.

In one aspect of the invention, a printing device may include a printing device body, a ribbon cassette that accommodates an ink ribbon and is detachable from the printing device body, an ink ribbon take-up mechanism that takes up the ink ribbon, an ink ribbon usage determining device that determines an amount of the ink ribbon consumed, a recording medium that stores an amount of the ink ribbon remaining, and a ribbon-empty determining device that determines that there is no amount of the ink ribbon remaining. When the ribbon-empty determining device determines that there is no amount of the ink ribbon remaining, it resets the recording medium.

According to the printing device, when it is determined that the ink ribbon has run out, the content of the recording medium is reset. Therefore, even when the ribbon cassette is used thereafter, it is easily recognized that there is no ink ribbon remaining, thereby preventing the user from reusing such a ribbon cassette.

BRIEF DESCRIPTION OF THE DRAWINGS

An embodiment of the invention will be described in detail with reference to the following figures wherein.

DETAILED DESCRIPTION OF PREFERRED EMBODIMENTS

An embodiment of the invention will be described in detail with reference to the accompanying drawings.

Figure 1:
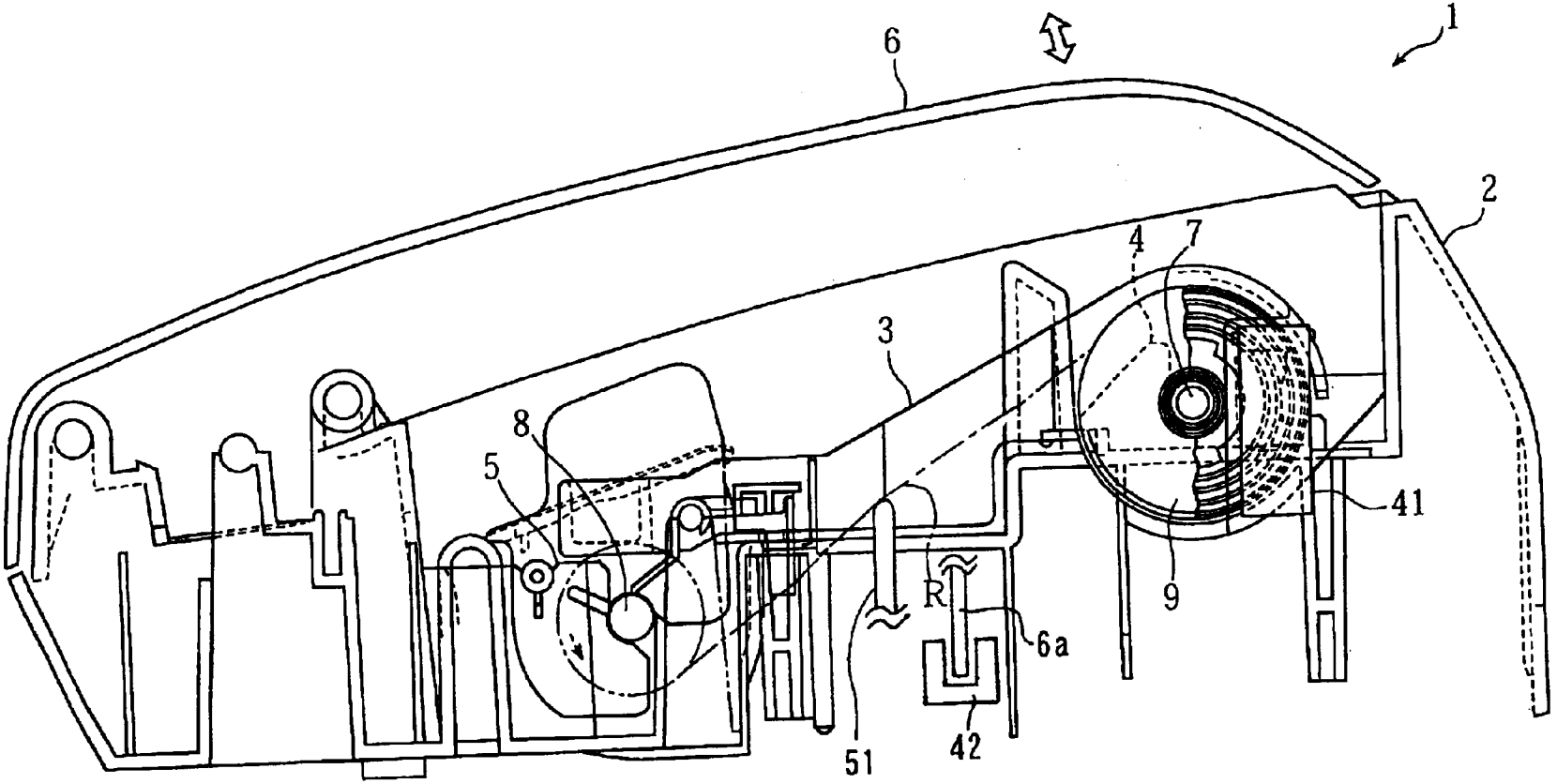
FIG. 1 shows an internal structure of a facsimile machine according to a first embodiment of the invention.
Figure 2B:
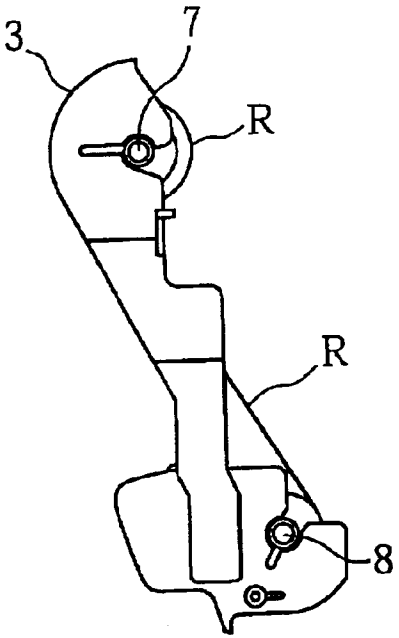
FIG. 2B is a side view of the ribbon cassette shown in FIG. 2A.
Figure 2A:
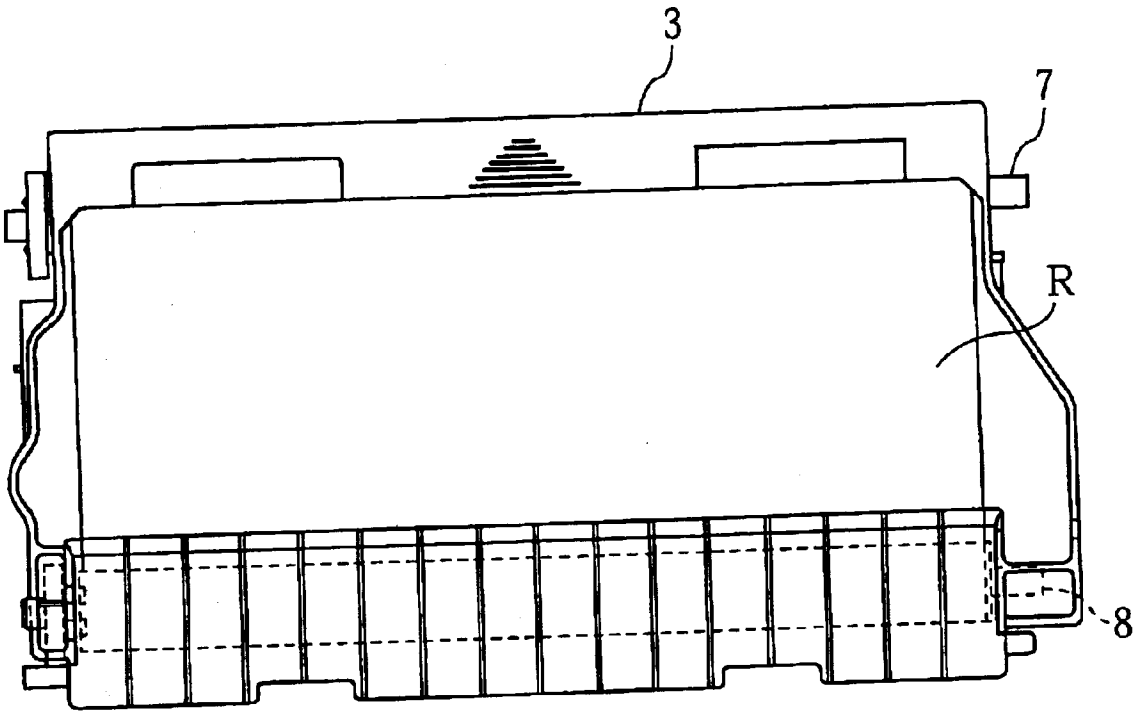
FIG. 2A is a top view of a ribbon cassette in which ink ribbon is accommodated.

A facsimile machine 1 shown in FIG. 1 is a multifunction product including the functions of thermal transfer printing, image reading (scanning), and faxing. In sending facsimile data for example, the facsimile machine 1 reads an original by the scanning function and sends the read facsimile data to a destination by the faxing function. In receiving the facsimile data, the facsimile machine 1 prints the contents of the facsimile data on a sheet by the printing function. The facsimile machine 1 can be also used as a standalone printing device or scanner, when it is connected to a personal computer. In addition, it can be used as a copier by linking the printing function together with the scanning function.

As shown in FIG. 1, the facsimile machine 1 is provided with a machine body 2, which includes bearings 4, 5 for attaching a ribbon cassette 3, and a body cover 6 over the machine body 2. The body cover 6 is openable to protect the inside of the facsimile machine 1. The facsimile machine 1 is also provided with a cover position detector 42 that detects whether the body cover 6 is open or closed. The cover position detector 42 is an optical sensor, and the cover 6 has a projection 6*a*. When the cover 6 is closed, the projection 6*a* cuts off a beam of the optical sensor 42, so that the optical sensor 42 is in the off state.

Figure 3:
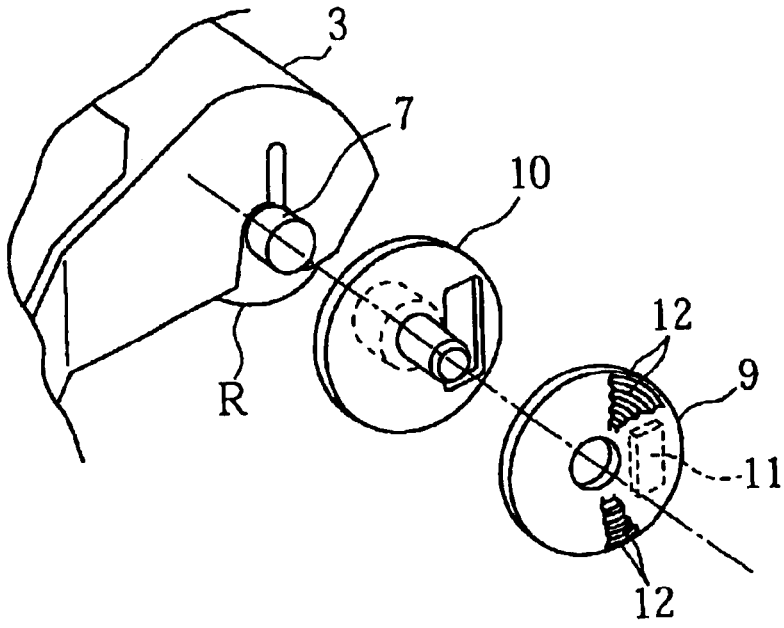
FIG. 3 is an exploded view showing essential parts of the ribbon cassette when a circuit board having an on-board EEPROM chip is attached to the ribbon cassette.

The ribbon cassette 3 has a supply shaft 7 for supplying ink ribbon R and a take-up shaft 8 for taking up the ink ribbon R. The ink ribbon R is looped over the both shafts 7, 8. An end portion of the take-up shaft 8 is connected to a take-up motor 50 that rotates the take-up shaft 8. One end portion of the supply shaft 7 receives a spool 10 for attaching a substantially circular plate shaped circuit board 9, as shown in FIG. 3. The other end portion of the supply shaft 7 is connected to a tension motor (not shown) for giving a tension to the ink ribbon R.

A ribbon-empty detector 51 that detects that the facsimile machine runs out of the ink ribbon R is provided in the machine body 2. The ribbon-empty detector 51 extends from a lower part of the machine body 2 to the body cover 6. When the ribbon cassette 3 is attached to the machine body 2, the tip of the ribbon-empty detector 51 is in contact with the ink ribbon R. When there is the ink ribbon R left, the ink ribbon R is slack, and the force to press down on the tip of the ribbon-empty detector 51 is weak. When the ink ribbon R is used up, slack in the ink ribbon R is gone and the ink ribbon R becomes taut, causing the ink ribbon R to press down on the tip of the ribbon-empty detector 51. Thereby, the ink ribbon-empty detector 51 detects that the ink ribbon R is used up.

Figure 4A:
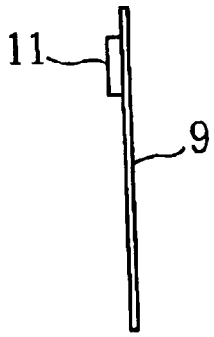
FIG. 4A is a side view of the circuit board.
Figure 4B:
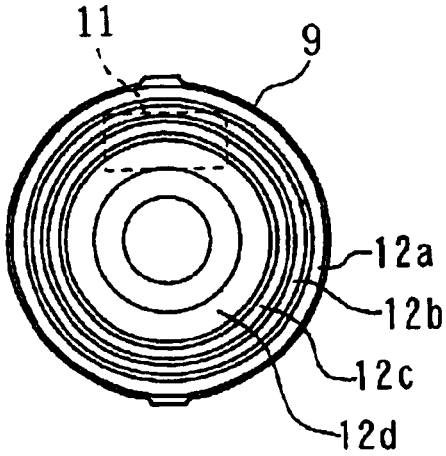
FIG. 4B is a front view of the circuit board.

As shown in FIGS. 4A and 4B, an EEPROM (electrically erasable programmable read only memory) 11 is mounted on the back of the circuit board 9. The EEPROM 11 is used to store the remaining amount of the ink ribbon R. Further, the EEPROM 11 stores individual, previously, stored, information about the ink ribbon R, such as the serial number and the production date. Conductor traces 12 are formed on the front side of the circuit board 9 so as to provide continuity between each of the conductor traces 12 and the corresponding one of the terminals of the EEPROM 11. The conductor traces 12 are formed in a ring shape and specified as a 5V-power trace 12*a*, a ground trace 12*b*, a control signal trace 12*c*, and a data signal trace 12*d* in this order from the outer edge of the circuit board 9 to the inside.

In the machine body 2 of the facsimile machine 1, an EEPROM reading unit 41 is provided, which makes contact with the circuit board 9 for connection. The EEPROM reading unit 41 has terminals (not shown) coming into contact with the conductor traces 12 of the circuit board 9. The terminals make contact with the conductor traces 12.of the circuit board 9 when the ribbon cassette 3 is mounted in the machine body 2.

Figure 5:
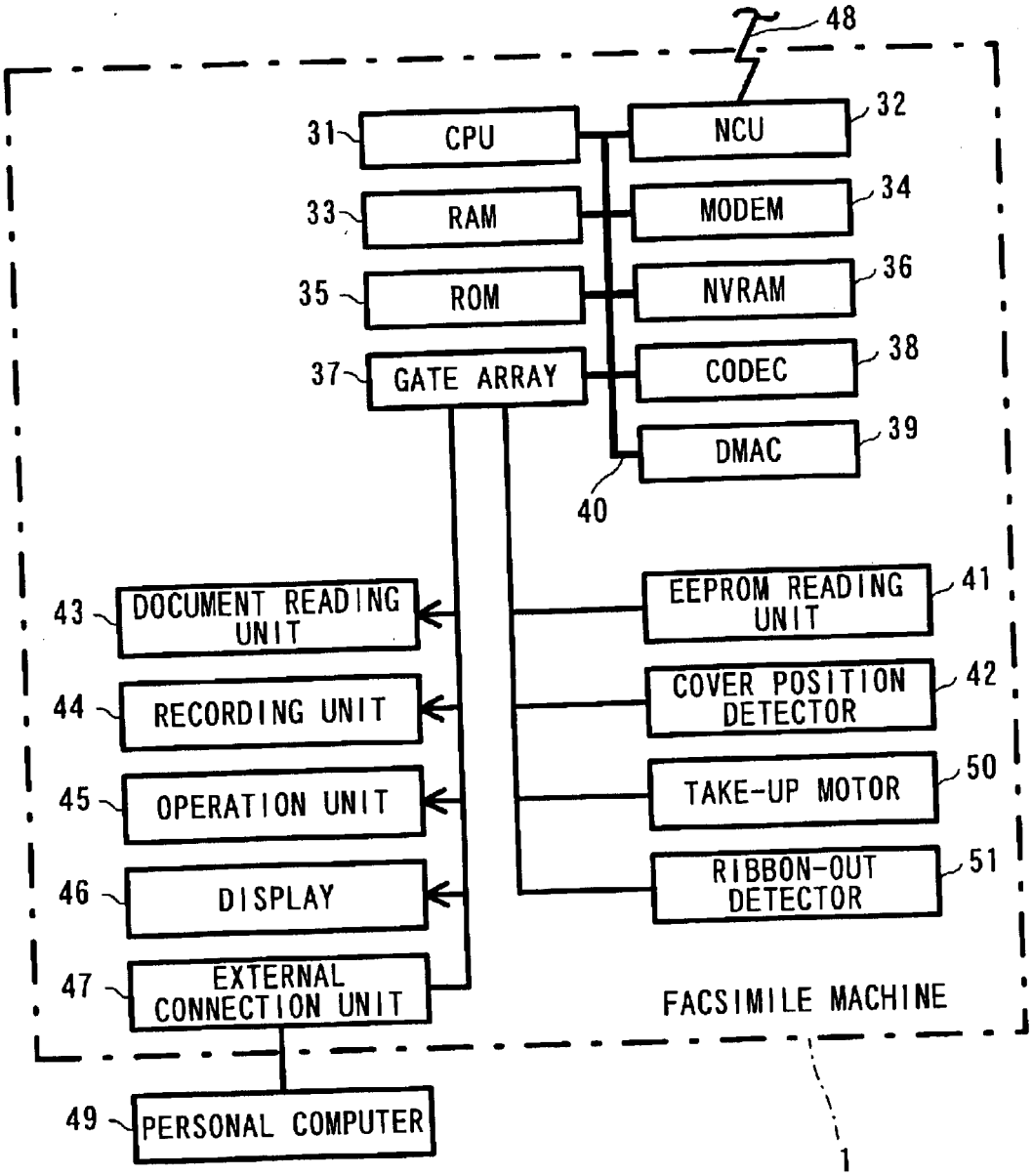
FIG. 5 is a block diagram showing an electrical structure of the facsimile machine shown in FIG. 1.

As shown in FIG. 5, the facsimile machine 1 includes a CPU (central processing unit) 31, a NCU (network control unit) 32, a RAM (random-access memory) 33, a modem 34, a ROM (read-only memory) 35, a NVRAM (non-volatile RAM) 36, a gate array 37, a Codec (coder-decoder) 38, and a DMAC (duobinary multiplexed analogue component) 39, which are all connected via a bus 40. The bus 40 includes an address bus, a data bus, and a control signal line. In the facsimile machine 1, the gate array 37 is connected to the EEPROM reading unit 41, the cover position detector 42, the take-up motor 50, the ribbon-empty detector 51, a document reading unit 43, a recording unit 44, an operation unit 45, a display unit 46, and an external connection unit 47. The NCU 32 is connected to a dialup line 48, and the external connection unit 47 is connected to a personal computer 49.

The CPU 31 controls all operations of the facsimile machine 1. The NCU 32 is connected to a public telephone line and performs network control. With the network control, both the facsimile data and individual information of the ink ribbon R can be transmitted.

The RAM 33 provides workspace for the CPU 31 and is a storage area for a count value as to the remaining amount of ink ribbon R. The modem 34 modulates or demodulates facsimile data and individual information of the facsimile machine 1. The ROM 35 stores programs and data manipulated by the CPU 31. The NVRAM 36 stores various data and information.

The gate array 37 functions as an interface between the CPU 31 and each unit 41–47, 50, 51. The Codec 38 encodes and/or decodes facsimile data. The DMAC 39 writes or reads data mainly to or from the RAM 33.

The EEPROM reading unit 41 reads the contents stored in the EEPROM 11 attached to the ribbon cassette 3. When the terminals make contact with the conductor traces 12 on the circuit board 9, the CPU 31 reads or writes data to or from the EEPROM 11.

The cover position detector 42 optically detects the opening and closing of the body cover 6, which is used to attach and detach the ribbon cassette 3. The cover position detector 42 transmits open/close signal of the body cover 6 to the CPU 31.

The take-up motor 50 is a stepping motor, and is connected to the take-up shaft 8, and driven according to pulse signals from the CPU 31.

The ribbon-empty detector 51 detects that the facsimile machine 1 has run out of the ink ribbon R in the ribbon cassette 3. A detection signal by the ribbon-empty detector 51 is transmitted to the CPU 31.

The document reading unit 43 includes an image sensor, an LED light source and a document feeding motor (which are not shown), and reads an image from a copy according to the control by the CPU 31.

The recording unit 44 performs monochrome or color printing of images such as text and objects by a thermal method.

The operation unit 45 includes keys and switches including a numeric keypad, and transmits an input signal in accordance with an operation by a user to the CPU 31.

The display unit 46 includes an LCD display, and displays various kinds of information.

The external connection unit 47 is connected to the personal computer 49 when the facsimile machine 1 is used as peripheral equipment, and exchanges data with the personal computer 49.

Figure 6:
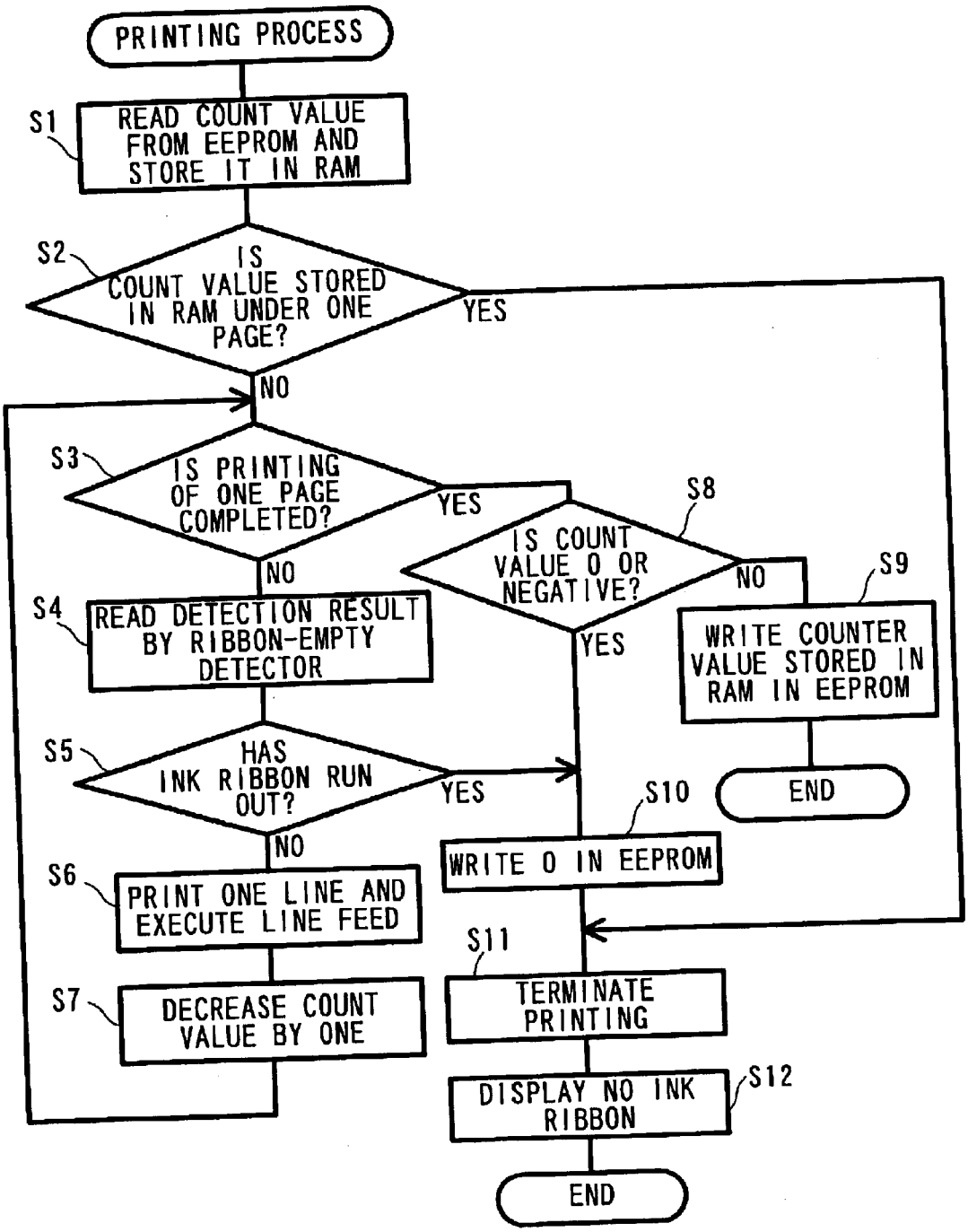
FIG. 6 is a flowchart of a printing process.

The operation control of the CPU 31 of the facsimile machine 1 will be described with reference to a flowchart of FIG. 6.

When the facsimile machine 1 is powered on or it is detected that the body cover 6 is closed based on the detection output by the cover position detector 42, the CPU 31 reads the contents of the EEPROM 11, that is, the count value as to the remaining amount of the ink ribbon R, and stores it in the RAM 33 (S1). In the ribbon cassette 3, the maximum quantity of the ink ribbon R to be consumed (the maximum number of printable lines, for example, 10000 lines) is previously stored in the EEPROM 11 before factory shipment.

The number of printable lines required for printing one page of a print sheet is predetermined, and the CPU 31 determines whether the count value stored in the RAM 33 is under one page, based on the predetermined number of printable lines (S2). A specified count value corresponding to the remaining amount of the ink ribbon R required for printing one page is predetermined. If the actual count value is the specified value or less, the CPU 31 determines that the remaining amount of the ink ribbon R does not satisfy the amount of the ink ribbon R required for printing one page. When the count value is under one page (S2: Yes), printing is terminated (S11), and the display unit 46 displays a message informing the user that ink ribbon R has run out (S12).

When the count value is one page or more, and therefore high enough to perform printing (S2: No), printing is started, and it is determined whether the printing of one page is completed (S3). When printing of one page is not completed (S3: No), the CPU 31 reads a detection result by the ribbon-empty detector 51 (S4), and determines whether the ink ribbon R has run out (S5).

When it is determined that the ink ribbon R has not run out (S5: No), one line is printed and a line feed is executed (S6). The count value stored in the RAM 33 is decreased by 1 (S7), and the process returns to S3.

At S3, when printing of one page is completed (S3: Yes), the CPU 31 determines whether the count value is 0 or negative (S8). When the count value is neither 0 nor negative (S8: No), the count value stored in the RAM 33 is written in the EEPROM 11 of the circuit board 9 (S9), and a printable state is maintained.

When, at S8, the count value is 0 or negative (S8: Yes), the count value stored in the EEPROM 11 of the circuit board 9 is forced to reset to 0. When, at S5, it is determined that the ribbon has run out (S5: Yes), the count value stored in the EEPROM 11 of the circuit board 9 is forced to reset to 0 regardless of the count value stored in the RAM 33 (S10). Then, printing is terminated (S11), and the display unit 46 displays a message informing the user that the ink ribbon R has run out (S12).

In this manner, when it is found that the ink ribbon R has run out in the middle of printing, the memory content of the EEPROM 11 of the circuit board 9 is reset, the printing is terminated, and the display unit 46 displays that there is no ink ribbon R remaining. The user can recognize the lack of the ink ribbon R at the sight of the display unit 46, and replace the ink ribbon R with a new one at an appropriate time.

Figure 7A:
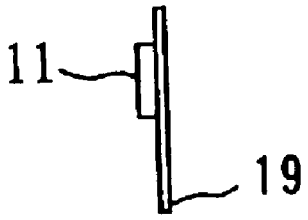
FIG. 7A is a side view of a circuit board according to a second embodiment of the invention.
Figure 7B:
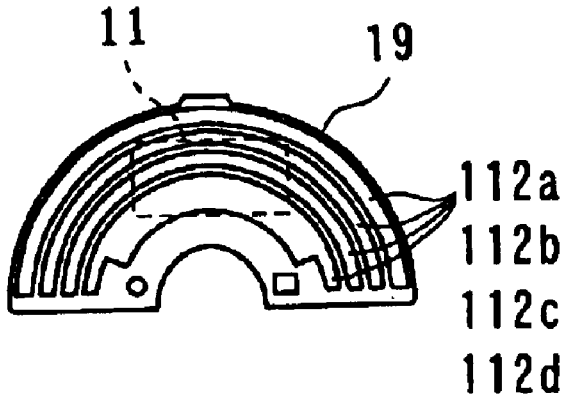
FIG. 7B is a front view of the circuit board shown in FIG. 7A.

A second embodiment of the invention will be described with reference to FIGS. 7A–13. The same parts as those in the first embodiment are designated by similar numerals for simplicity. As shown in FIGS. 7A and 7B, a substantially semicircular shaped circuit board 19 is used. Conductor traces 112 are sectorially formed on a surface of the circuit board 19 along its radius. They are a 5V-power trace 112*a*, a ground trace 112*b*, a control signal trace 112*c*, and a data signal trace 112*d* in this order from the outer edge of the circuit board 19 to the inside. In this case, the data signal trace 112*d* is regarded as a trace for detecting a contact between the conductor patterns 112 and the terminals (not shown) of the EEPROM reading unit 41 provided in the machine body 2 of the facsimile machine 100.

According to the above structure, the take-up shaft 8 is rotated by the take-up motor 50, and the supply shaft 7 is subsequently rotated. Accordingly, the conductor traces 112 alternately make contact with and do not make contact with the terminals of the EEPROM reading unit 41. Hereinafter, it is to be understood that when the term "contact" is used, it applies to a contact between the conductor traces 112 and the terminals of the EEPROM reading unit 41. A period of time in which the conductor traces 112 make contact with the terminals is hereinafter referred to as an "on time", and a period of time in which the conductor traces 112 are out of contact with the terminals is hereinafter referred to as an "off time". In this case, while the circuit board 19 goes into a 360-degree roll, the on time and the off time are outputted at a ratio of about 50% because the circuit board 19 is of a substantially semicircle.

Figure 8:
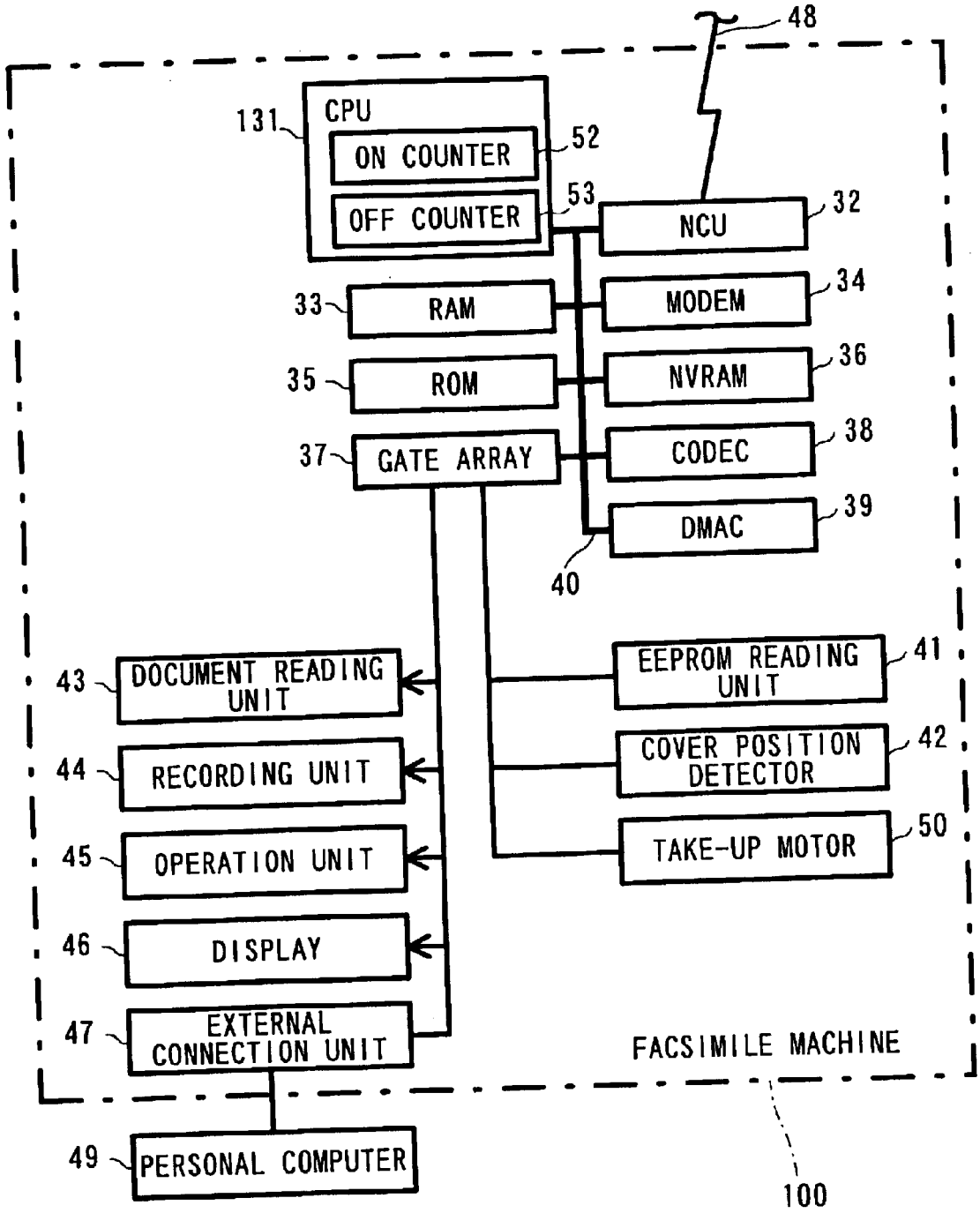
FIG. 8 is a block diagram showing an electrical structure of the facsimile machine according to the second embodiment.
Figure 9:
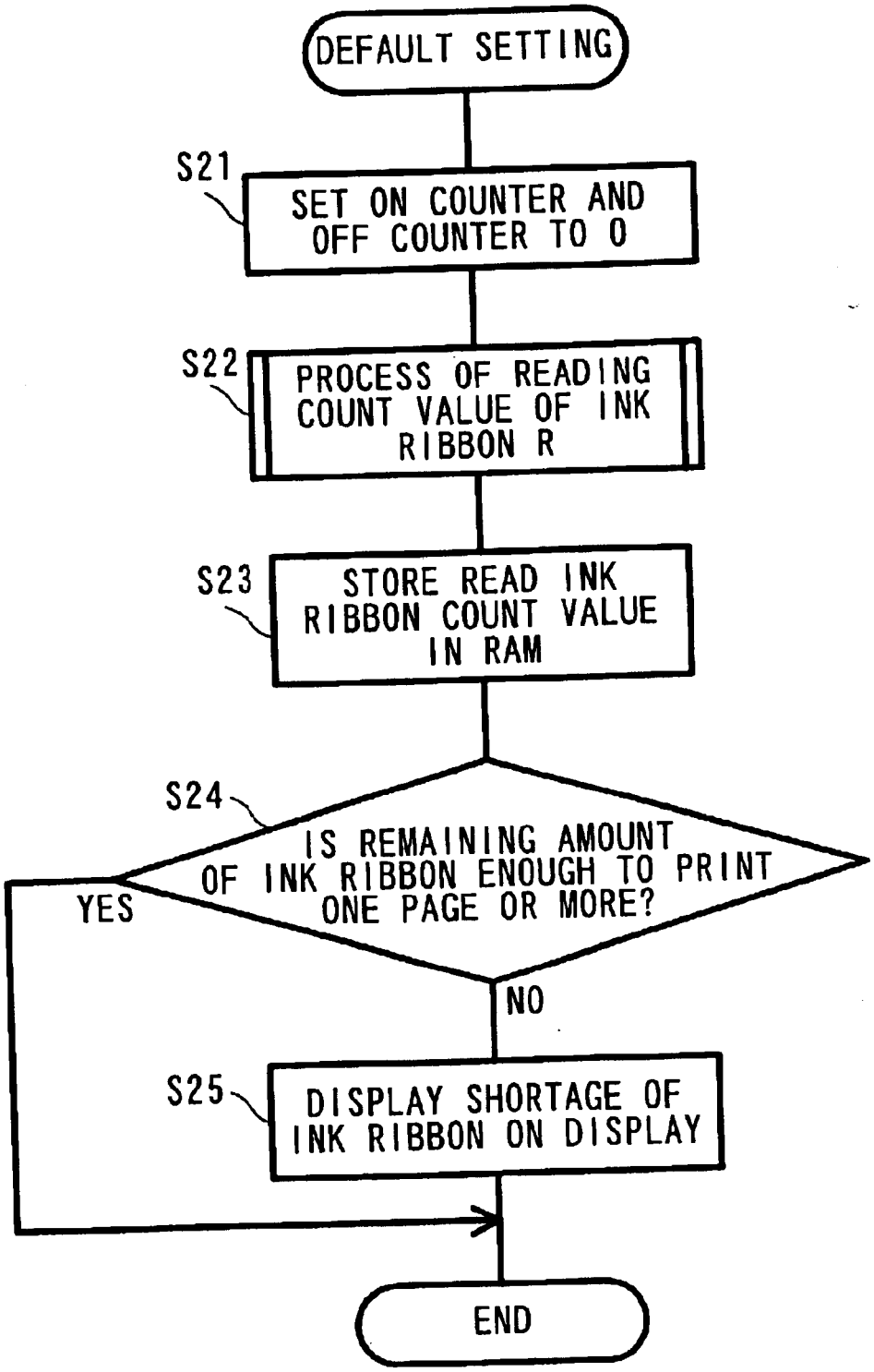
FIG. 9 is a flowchart of a default setting process according to the second embodiment.

As shown in FIG. 8, a CPU 131 includes an on counter 52 and an off counter 53. The on counter 52 counts the number of pulses of the take-up motor 50 during the on time while the off counter 53 counts the number of pulses of the take-up motor 50 during the off time.

Other arrangements are substantially the same as those of the first embodiment.

FIGS. 9 to 13 are flowcharts showing operation controls by the CPU 131 in the second embodiment. First, the CPU 131 executes default settings. When a facsimile machine 100 is powered on or it is found that the body cover 6 is closed based on a detection by the cover position detector 42, the CPU 131 resets both the on counter 52 and the off counter 53 to 0 (S21). Then it goes into a process of reading the count value of the ink ribbon R (S22).

Figure 10:
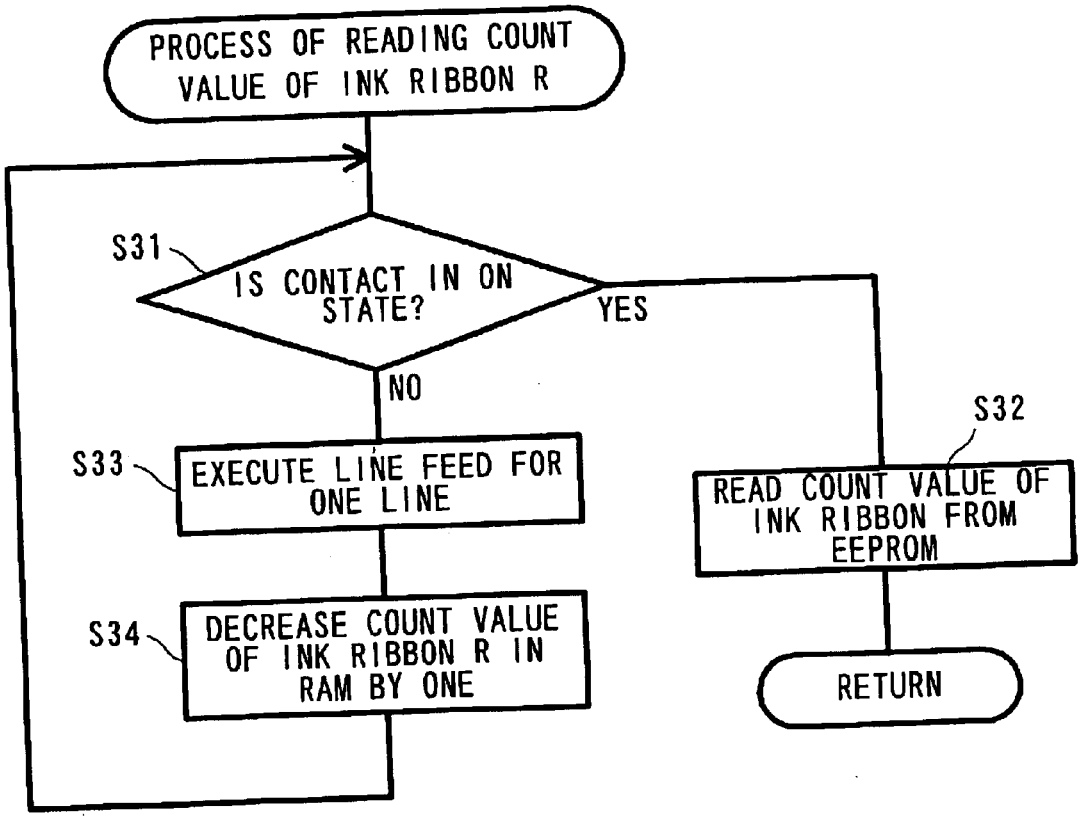
FIG. 10 is a flowchart of a process for reading a count value of ink ribbon according to the second embodiment.

FIG. 10 shows a process of reading the count value of the ink ribbon R. The CPU 131 determines whether the contact is in the on state (S31). To read the content of the EEPROM 11, the contact must be in the on state. When the contact is in the on state (S31: Yes), the CPU 131 reads the count value of the ink ribbon R stored in the EEPROM 11 of the circuit board 19 (S32). Then the process advances to S23 shown in FIG. 9.

On the other hand, when the contact is not in the on state (S31: No), a line feed is executed for one line (S33). Then, the CPU 131 decreases the count value of the ink ribbon R stored in the RAM 33 by one (S34), and the process returns to S31. That is, the line feed is repeatedly executed until the contact is in the on state.

Returning to FIG. 9, the CPU 131 stores the count value of the ink ribbon R read from the EEPROM 11 in the RAM 33 (S23). Then, the CPU 131 determines whether the remaining amount of the ink ribbon R is enough to print one page or more (S24). When the remaining amount of the ink ribbon R does not reach the amount for one page (S24: No), the display unit 46 displays a message that, for example, the ink-ribbon R will run out soon (S25).

When the remaining amount of the ink ribbon R is enough to print one page or more (S24: Yes) or the display unit 46 displays the message as such (S25), the CPU 131 completes the default setting.

Figure 11:
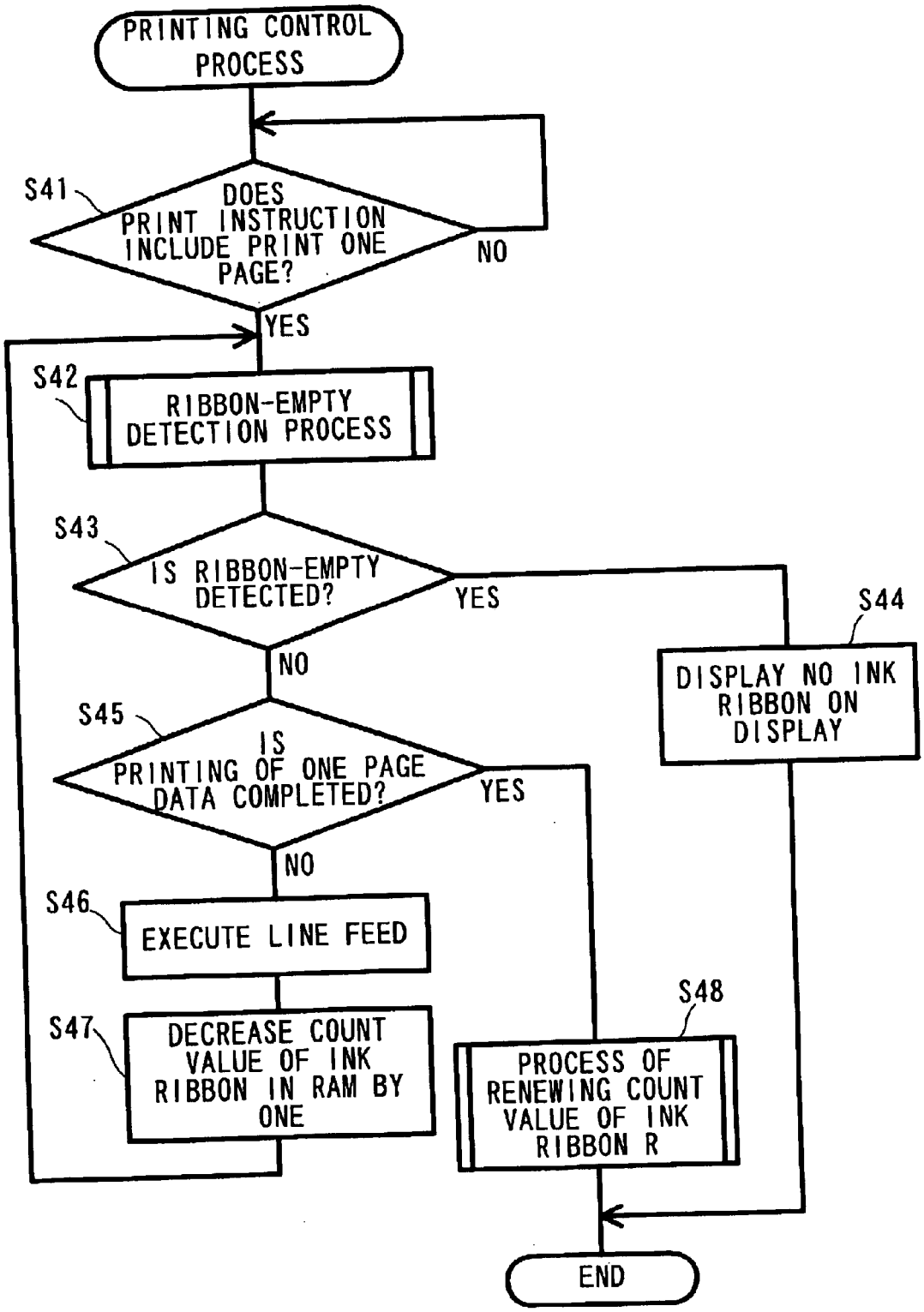
FIG. 11 is a flowchart of a printing control process according to the second embodiment.

Then, as shown in FIG. 11, the facsimile machine 100 executes printing based on a print instruction issued, for example, when a facsimile arrives. The CPU 131 determines whether the print instruction includes print one page (S41). When the print instruction includes print one page (S41: Yes), the CPU 131 executes a ribbon-empty detection process (S42).

Figure 12:
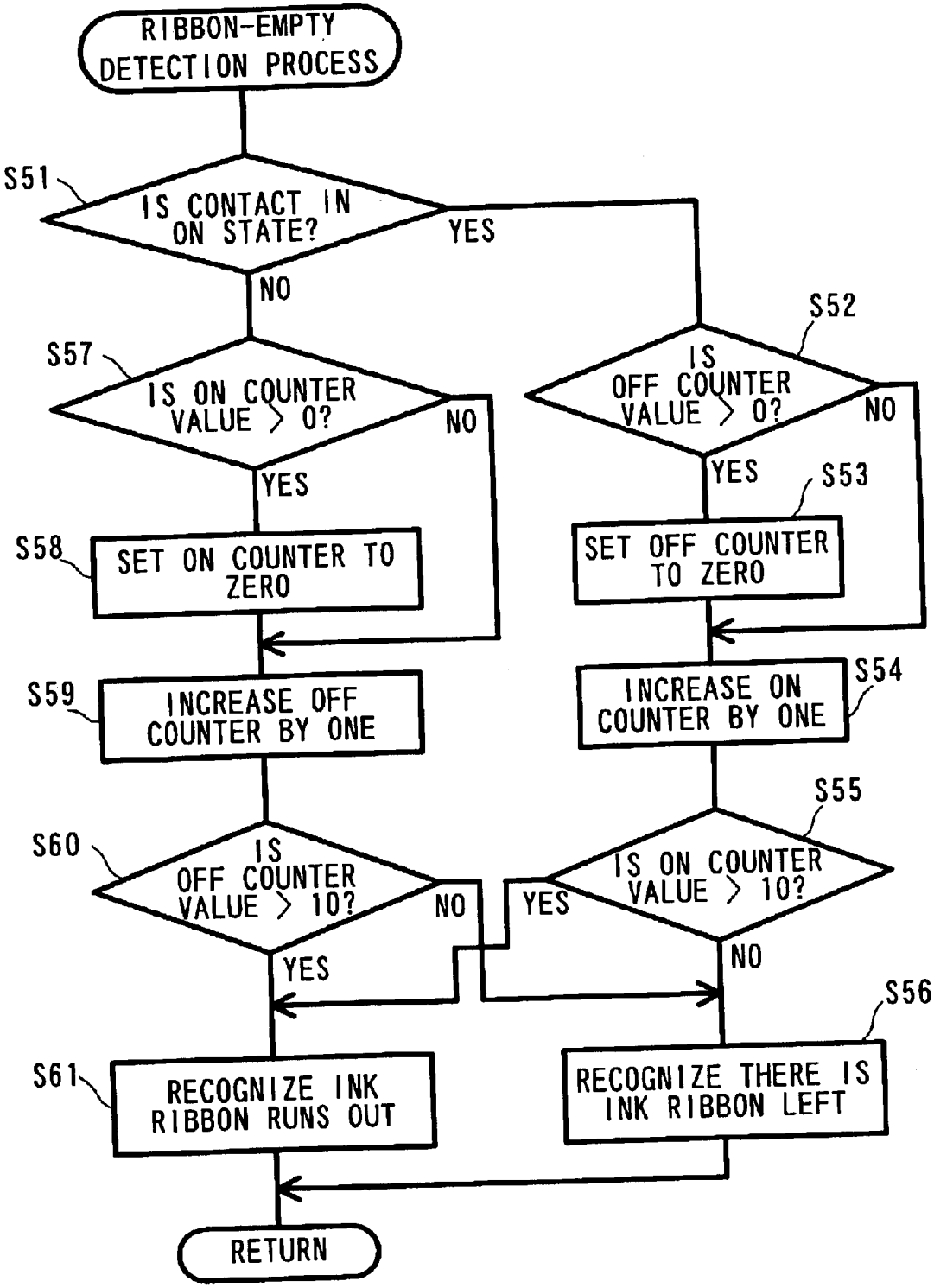
FIG. 12 is a flowchart of a ribbon-empty detection process according to the second embodiment.

In the ribbon-empty detection process, as shown in FIG. 12, the CPU 131 determines whether the contact is in the on state (S51). When the contact is in the on state (S51: Yes), the CPU 131 determines whether the value of the off counter 53 is greater than 0 (S52). When the value of the off counter 53 is greater than 0 (S52: Yes), the CPU 131 resets the off counter 53 to 0 (S53). When the value of the off counter 53 is 0 (S52: Yes) or is reset to 0 (S53), the CPU 131 adds one to the value of the on counter 52 (S54).

Then, the CPU 131 determines whether the value of the on counter 52 is greater than 10 (S55). When the value of the on counter 52 is not greater than 10 (S55: No), the CPU 131 recognizes that there is ink ribbon R remaining (S56). When the value of the on counter 52 is greater than 10 (S55: Yes), the CPU 131 recognizes that the ink ribbon R has run out (S61). Although the ink ribbon R is wound by the take-up motor 50, if the supply shaft 7 is not rotated because of the shortage of the ribbon, the circuit board 19 is stopped, and the value of the on counter 52 continues to increase. When the value becomes greater than 10, it is found that the ribbon has been consumed.

When at S51 the contact is not in the on state (S51: No), the CPU 131 determines whether the value of the on counter 52 is greater than zero (S57). When the value of the on counter 52 is greater than zero (S57: Yes), the CPU 131 resets the on counter 52 to zero (S58). When the value of the on counter 52 is zero (S57: No) or it is reset to zero (S58), the CPU 131 adds one to the value of the off counter 53 (S59).

Then, the CPU 131 determines whether the value of the off counter 53 is greater than 10 (S60). When the value of the off counter 53 is not greater than 10 (S60: No), the CPU 131 recognizes that there is ink ribbon R remaining (S56). When the value of the off counter 53 is greater than 10 (S60: Yes), the CPU 131 recognizes that the ribbon has run out (S61). Although the ribbon is wound by the take-up motor 50, if the supply shaft 7 is not rotated because of the shortage of the ribbon, the circuit board 19 is stopped, and the value of the off counter 53 continues to increase. When the value becomes greater than 10, it is found that the ribbon has been consumed.

Returning to FIG. 11, when the CPU 131 determines that the ribbon has run out in the ribbon-empty detection process (S43: Yes), the display unit 46 displays that there is no ink ribbon R remaining (S44). When the CPU 131 does not determine that the ribbon has run out (S43: No), it determines whether the printing of one page of data is completed (S45).

At S45, when printing of one page of data is not completed (S45: No), one line is printed and a line feed is executed (S46). Then, the CPU 131 decreases the count value of the ink ribbon R stored in the RAM 33 by one (S47). The process returns to S42 and the CPU 131 performs the ribbon-empty detection process again.

Figure 13:
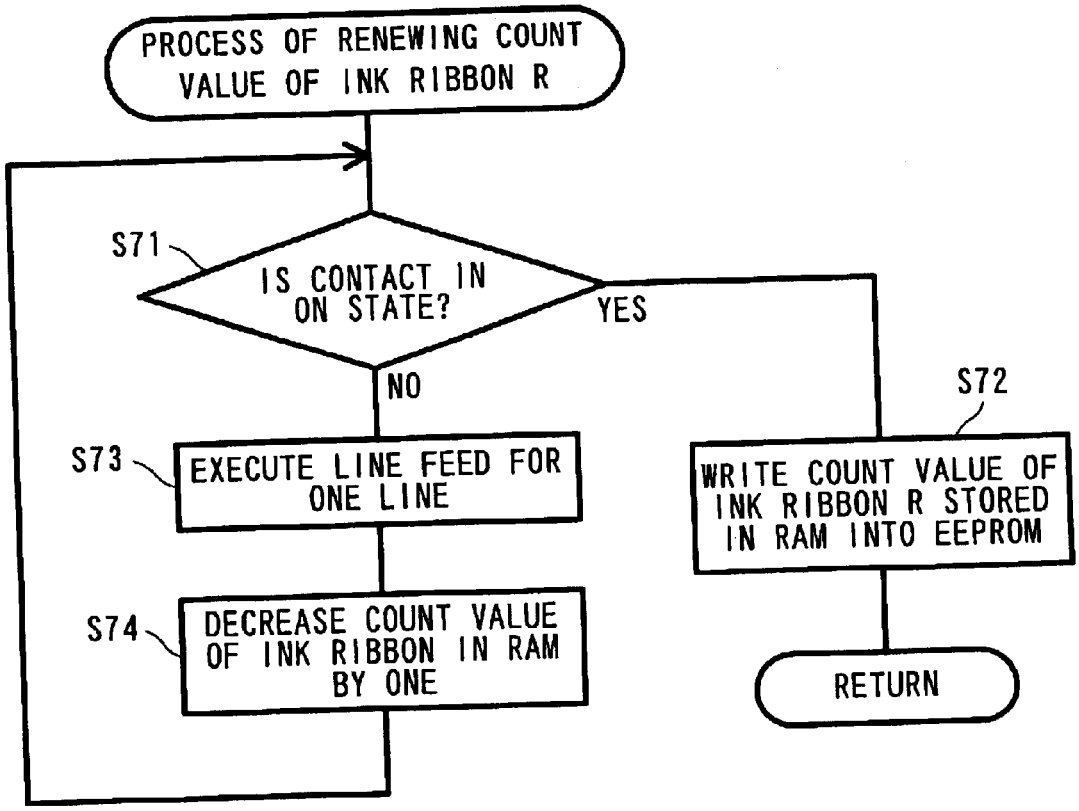
FIG. 13 is a flowchart of a process for renewing the count value of the ink ribbon according to the second embodiment.

When printing of one page of data is completed (S45: Yes), the CPU 131 executes a process of renewing the count value of the ink ribbon R (S48). As shown in FIG. 13, the CPU 131 determines whether the contact is in the on state (S71). When the contact is in the on state (S71: Yes), the CPU 131 writes the count value of the ink ribbon R stored in the RAM 33 into the EEPROM 11 of the circuit board 19 (S72).

When, at S71, the contact is in the off state (S71: No), a line feed is executed for one line (S73). Then, the CPU 131 decreases the count value of the ink ribbon R stored in the RAM 33 by one (S74), and the process returns to S71. That is, the line feed is repeatedly executed until the contact is in the on state.

Because the count value of the ink ribbon R stored in the EEPROM 11 is renewed based on the presence or absence of the conductor traces 112 formed on the front side of the circuit board 19 that rotates along with the supply shaft 7, the accurate remaining amount of ink ribbon R can be achieved.

In the second embodiment as described above, through the use of the substantially semicircular shaped circuit board 19, the on time, where the conductor traces 112 make contact with the terminals of the EEPROM reading unit 41, and the off time, where the conductor traces 112 make out of contact with the terminals, are generated. The on time and the off time make it possible to detect a lack of the ink ribbon R.

Figure 14A:
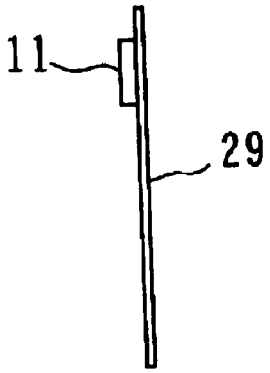
FIG. 14A is a side view of a circuit board according to a third embodiment of the invention.
Figure 14B:
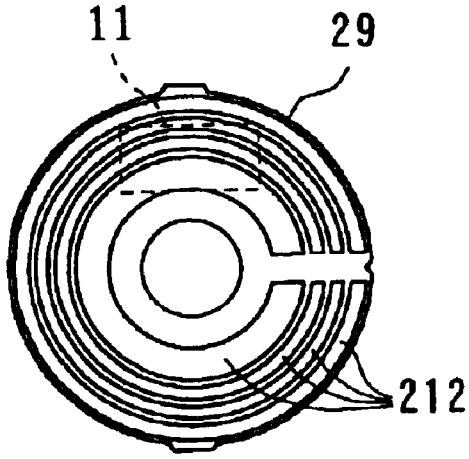
FIG. 14B is a front view of the circuit board shown in FIG. 14A.

In a third embodiment of the invention shown in FIG. 14, a substantially circular shaped circuit board 29 having conductor patterns 212 formed thereon shaped in a substantially ring partly missing, is used. The third embodiment operates in the same manner as the second embodiment without the use of a substantially semicircular circuit board.

Figure 15:
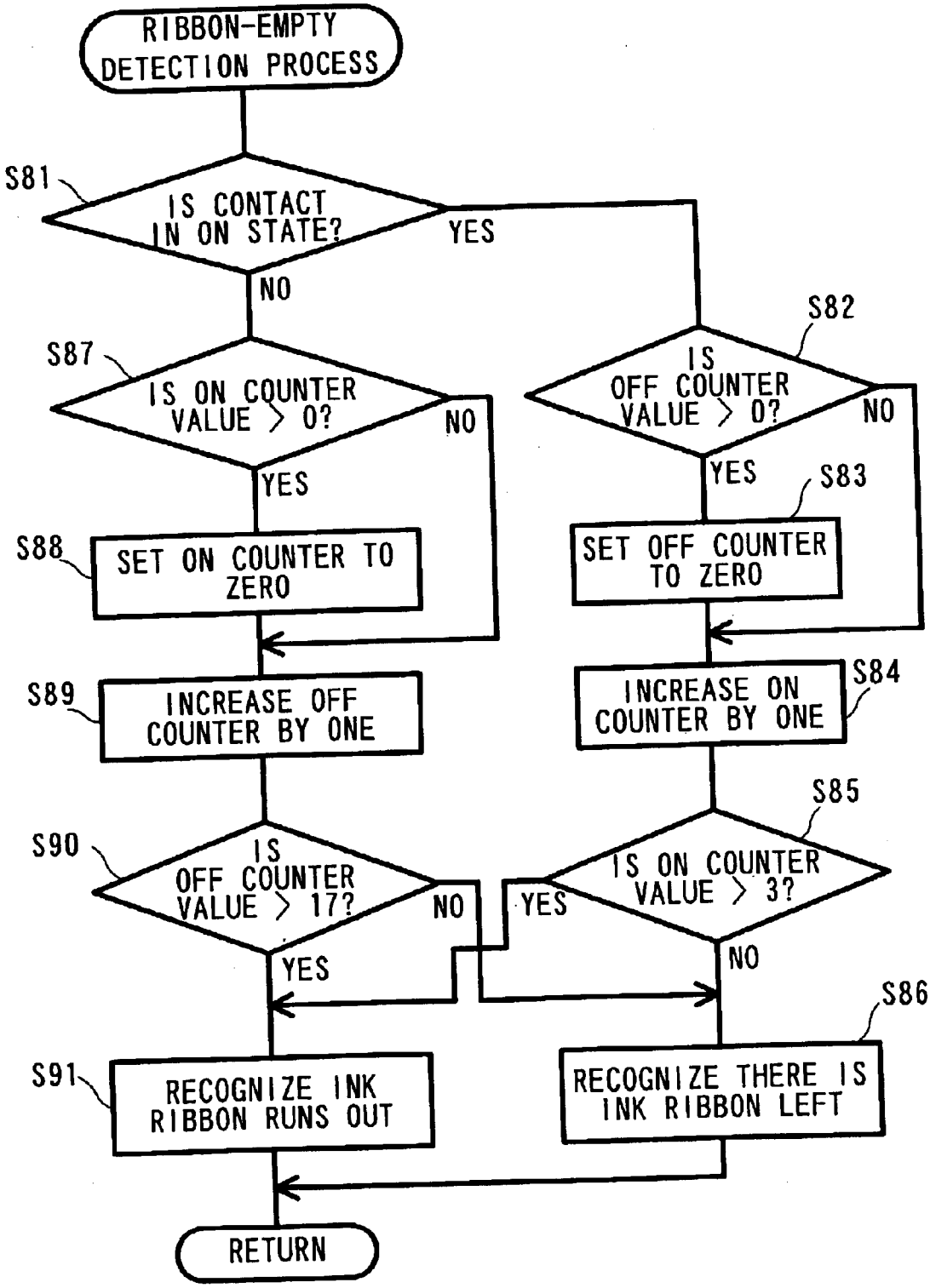
FIG. 15 is a flowchart of a ribbon-empty detection process according to the third embodiment.

A ribbon-empty detection process according to the third embodiment shown in FIG. 15 will be described. Steps S81 to S84, S86 to S89, and S91 are the same as the steps S51 to S54, S56 to S59, and S61 shown in FIG. 12, respectively, and the flowchart proceeds in the same manner. At S90, the CPU 131 determines whether the counter value of the off counter 53 is greater than 17. At S85, the CPU 131 determines whether the count value of the on counter 52 is greater than 3. Even though the values of the on counter 52 and the off counter 53 are set to 3 and 17 respectively, they can be changed according to the length of each of the conductor patterns 212 of the circuit board 29.

While the invention has been described in detail and with reference to the specific embodiments thereof, it would be apparent to those skilled in the art that various changes, arrangements and modifications may be applied therein without departing from the spirit and scope of the invention.

What is claimed is:

1. A printing device, comprising:

a printing device body;

a ribbon cassette that accommodates an ink ribbon and is detachable from the printing device body, an ink ribbon take-up mechanism that takes up the ink ribbon;

an ink ribbon usage determining device that determines an amount of the ink ribbon consumed;

a recording medium that stores an amount of the ink ribbon remaining; and a ribbon-empty determining device that determines that there is no amount of the ink ribbon remaining, wherein the ribbon-empty determining device resets a content of the recording medium when it determines that there is no amount of the ink ribbon remaining.

2. The printing device according to claim 1, wherein the ribbon-empty determining device determines that the ink ribbon take-up mechanism has been stopped over a specified period of time.

3. The printing device according to claim 2, wherein the ribbon cassette has a first shaft around which the ink ribbon is wound and a second shaft that takes up the ink ribbon, and the ribbon-empty determining device determines that one of the shafts has been stopped over a specified period of time.

4. The printing device according to claim 3, further comprising:

a plate which is attached to the first shaft;

a conductor which is disposed on the plate and formed concentric with the first shaft and has a missing part; and a contact member that makes contact with the conductor, the contact member electrically connected to the ribbon-empty determining device, wherein the ribbon-empty determining device detects a presence or absence of the conductor when the first shaft is rotated by the take-up mechanism and the plate is rotated, and determines that a detected state of the conductor has lasted over a specified period of time.

5. The printing device according to claim 4, wherein the ribbon-empty determining device further comprises a counter, the ribbon-empty determining device determines that a value of the counter, which is incremented while the ribbon-empty determining device detects the conductor, reaches a first specified value, and the ribbon-empty determining device determines that a value of the counter, which is incremented while the ribbon-empty determining device detects the missing part of the conductor, reaches a second specified value.

6. The printing device according to claim 5, wherein the plate is a disk.

7. The printing device according to claim 6, wherein the recording medium is disposed on a surface of the plate opposite from a surface where the conductor is formed, and is electrically connected to the ink ribbon usage determining device and the ribbon-empty determining device via the conductor and the contact member.

8. The printing device according to claim 5, wherein the plate is formed in a semicircle and the conductor is formed in a semicircle.

9. The printing device according to claim 8, wherein the recording medium is disposed on a surface of the plate opposite from a surface where the conductor is formed, and is electrically connected to the ink ribbon usage determining device and the ribbon-empty detector via the conductor and the contact member.

10. A printing device, comprising:

a printing device body;

a consumable item for printing detachable from the printing device body;

a usage determining device that determines an amount of the consumable item consumed;

a recording medium that stores an amount of the consumable item remaining; and a consumable item-empty determining device that determines that there is no amount of the consumable item remaining, wherein the consumable item-empty determining device resets a content of the recording medium when it determines that there is no amount of the consumable item remaining.

11. A device that determines a usage of an ink ribbon accommodated in a ribbon cassette in which the ink ribbon is wound around a first shaft and taken up by a second shaft, the device comprising:

a disk that is attached to the first shaft;

a conductor that is disposed on the disk and formed concentric with the first shaft and has a missing part;

a contact member that makes contact with the conductor; and an ink ribbon usage determining circuit that is electrically connected to the contact member and detects the missing part of the conductor to determine the number of rotations of the first shaft.

12. The device according to claim 11, wherein the ink ribbon usage determining circuit further comprises a counter, the ribbon usage determining circuit determines that a value of the counter, which is incremented while the ribbon usage determining circuit detects the conductor, reaches a first specified value, and the ribbon usage determining circuit determines that a value of the counter, which is incremented while the ribbon usage determining circuit detects the missing part of the conductor, reaches a second specified value.

13. The printing device according to claim 7, wherein the printing device is a facsimile machine.

14. The printing device according to claim 9, wherein the printing device is a facsimile machine.

15. The printing device according to claim 10, wherein the printing device is a facsimile machine.

16. The device according to claim 12, wherein the device is a facsimile machine.

17. The printing device according to claim 7, wherein the printing device is a combination facsimile, scanner, and printer.

18. The printing device according to claim 9, wherein the printing device is a combination facsimile, scanner, and printer.

19. The printing device according to claim 10, wherein the printing device is a combination facsimile, scanner, and printer.

20. The device according to claim 12, wherein the device is a combination facsimile, scanner, and printer.

* * * * *